United States Patent [19]

Harris et al.

[11] 3,970,152

[45] July 20, 1976

[54] MUD ACTUATED DRILLING TOOL

[75] Inventors: Jesse W. Harris; Ross Bassinger; Grey Bassinger, all of San Antonio, Tex.

[73] Assignee: Bassinger Tool Enterprises, Ltd., San Antonio, Tex.

[22] Filed: June 14, 1974

[21] Appl. No.: 479,369

[52] U.S. Cl. ..... 173/15; 173/67; 173/73; 91/50

[51] Int. Cl.[2] ..... E21B 1/06

[58] Field of Search ..... 173/15, 73; 91/50; 175/92

[56] References Cited

UNITED STATES PATENTS

| | | | |
|---|---|---|---|
| 1,892,517 | 12/1932 | Pennington | 175/65 |
| 2,620,162 | 12/1952 | Pennington | 173/73 |
| 2,943,603 | 7/1960 | Bassinger | 91/50 X |
| 3,038,548 | 6/1962 | Brown | 91/50 X |
| 3,051,134 | 8/1962 | Lincoln | 91/50 X |
| 3,162,251 | 12/1964 | Bassinger | 173/73 |
| 3,195,657 | 7/1965 | Collier | 173/73 X |
| 3,225,841 | 12/1965 | Thompson | 173/15 |
| 3,361,220 | 1/1968 | Brown | 175/296 X |
| 3,595,323 | 7/1971 | Schindler | 173/73 X |
| 3,768,576 | 10/1973 | Martini | 173/73 |

*Primary Examiner*—Ernest R. Purser

*Attorney, Agent, or Firm*—Cox, Smith, Smith, Hale & Guenther Incorporated

[57] ABSTRACT

A fluid operated impact drilling device wherein a hammer is mounted in a casing for axial reciprocating movement and drilling fluid flows through the hammer. The flow of drilling fluid is controlled by a valve element at the upper portion of the hammer. Differential pressure areas are provided in the flow path of the drilling fluid which coupled with the action of the valve element causes the hammer to be repeatedly lifted up into the valve element and then driven downward against an anvil by the force of the drilling mud. The valve element remains partly open, thereby preventing excessive backpressures from damaging the drill pipe or equipment. The drilling device is attached immediately above the drill bit with the drill bit being secured to the anvil. A catcher device is mounted to stop the reciprocating impact action of the hammer against the anvil upon picking the bit up off bottom.

15 Claims, 11 Drawing Figures

MUD ACTUATED DRILLING TOOL

BACKGROUND OF THE INVENTION

This invention relates to a fluid actuated percussion type drilling device and, more particularly, to a percussion type drilling device that can be used in the petroleum drilling industry and actuated by the hydraulic fluid.

DESCRIPTION OF THE PRIOR ART

Early in the petroleum drilling industry it was a common problem for the drill bit to become lodged in the well. To free the bit, various types of jarring devices were initially devised that could be fluid or pneumatically operated. An example of an earlier type jarring device is contained in U.S. Pat. No. 1,637,505 issued on Aug. 2, 1927. The jarring devices would normally have some type of reciprocating hammer that would act upward in an attempt to free the drill bit. As time passed improvements were made on the jarring mechanisms and numerous patents have issued relating thereto.

Also, as time passed, consideration was given to the reversing of the hammer action in a jarring tool in an attempt to increase the drilling speed through hard rock formations by having a reciprocating hammer action downward on the bit. The earlier devices propose the use of a pneumatic fluid such as air, individually or in conjunction with the drilling mud. The pneumatic fluid would operate the hammer, while the drilling mud raised the cuttings from the well to the surface. An example of a pneumatic type of drilling device can be found in U.S. Pat. No. 3,050,032 issued on Aug. 22, 1962. Another example of a pneumatic impact device using a hammer action against the anvil and bit can be found in U.S. Pat. No. 3,616,868 issued on Nov. 2, 1971.

One of the major problems with a pneumatic type of drilling device in the petroleum industry is that the pneumatic fluid will not raise the cuttings to the surface of the well. To raise the cuttings to the surface of the well, a drilling mud is normally required. Therefore, if the percussion device is pneumatically operated, the source of pressurized air must be strong enough to raise the cuttings to the surface of the hole, or must be used alternately or in conjunction with a drilling mud. The use of pressurized air and a drilling mud either together or alternately is very expensive without a substantial savings in drilling time.

Since the early 50's one of the co-inventors of the present invention has been trying to develop a drilling device that can be actuated by the normal pressure of the drilling mud across the drill bit. Examples of some of the earlier efforts by one of the co-inventors of the present invention to develop a suitable mud actuated drilling device can be found in U.S. Pat. Nos. 2,758,817, 2,764,130 and 2,756,723; however, because of the very abrasive qualities of the drilling mud, the pressure of the mud across the drill bit and the incompressibility of the mud column none of the prior devices would work correctly over a respectable life span to make them economically worthwhile.

Various other individuals and organizations have also expended considerable amounts of money in an attempt to develop a mud actuated drilling tool with one of the more recent examples being shown in U.S. Pat. No. 3,491,838 and its improvement U.S. Pat. No. 3,712,387. However, as hinted towards in the patents, the valve element was subject to severe erosion, which resulted in a very short life span.

U.S. Pat. No. 3,167,136 issued on Jan. 26, 1965 shows another major effort that was made to develop a mud actuated drilling tool. This patent was not successful because of the inherent difficulties in mud actuated devices. The valve member was carried inside of the hammer element and operated between the hammer and anvil which made the valve member subject to a tremendous amount of jarring action against the valve seat.

Another major effort that was made to develop a mud actuated drilling bit can be found in U.S. Pat. No. 2,774,334 issued on Dec. 18, 1956 wherein the valve element is again carried inside a hammer or jarring portion. Again this device was not economically feasible because of the tremendous erosion effect and other difficulties inherent in a mud actuated drilling device.

Each of the above mentioned patents relating to mud actuated drilling devices represent considerable expenditures of money by the assignee in an attempt to develop a workable device. The two basic problems that the above devices could not conquer was the tremendous backpressure that an incompressible column of mud would develop upon stopping flow by valve element. The other major problem involved wear on the valve element or seat caused by the tremendous backpressure and abrasive qualities of the mud.

SUMMARY OF THE INVENTION

It is an object of the present invention to show a mud actuated, percussion type, rotary drilling tool.

It is a further object of the present invention to provide a downward hammer action on a rotary drill bit.

It is yet another object of the present invention to provide a mud actuated drilling tool comprising only two moving parts, a valve element and a hammer that acts against an anvil to which a drill bit is attached.

It is even another object of the present invention to provide a mud actuated drilling tool that can prevent excessive backpressures and also have a reasonable life expectancy when in operation.

It is still a further object of the present invention to provide a means so that drilling mud can leak through the valve element, thereby helping prevent excessive backpressure in the mud column.

It is an even further object of the present invention to provide a catcher means that prevents reciprocating hammer action upon lifting the rotary drill bit off of the bottom of the well.

It is another object of the present invention to provide direct access through the mud actuated drilling tool to the bottom of the well and/or uninterrupted flow of the mud.

In actual practice, the mud actuated drill bit will be connected in the drill pipe string immediately above the drill bit. By using area differentials in a hammer element, the hammer element begins to rise as fluid flow creates a back pressure across the drilling bit. As the hammer element reaches a certain height, it enters the valve element to cut off the flow of the mud. Backpressure builds up urging the valve element and the hammer element downward. Because the weight to area ratio of the valve element is less, it will immediately telescope over the hammer element. The hammer element, because of the greater weight, will subsequently follow the valve element downward to strike an anvil to which the drill bit is attached. As the hammer is driven down, it leaves the valve element again opening up a path for mud flow, thereby starting the cycle over again. As the hammer element slides inside of the valve element to essentialy cut off the flow of the drilling fluid, the hammer element never seats against the value element. A restrictive orifice is located inside of the hammer element that allows some of the mud to leak past the valve, thereby preventing excessive backpressure that could damage the drill pipe. This restrictive orifice can be fished out from the surface in a very short period of time to allow direct access to the bottom of the well. At the lower portion of the hammer is a catcher element so that when the drill bit is raised off of the bottom of the well, the hammer will be pulled down, thereby allowing free flow of the mud through the mud drilling tool. This will prevent any reciprocating action of the hammer and valve when the drill bit has been raised off bottom. The anvil element to which the drill bit is attached is in sliding relationship with the mud drilling tool housing so that upon receiving a downward force from the hammer, the anvil and bit drives down against the substance through which the well is currently being drilled.

DESCRIPTION OF THE PREFERRED EMBODIMENT

Figure 1:
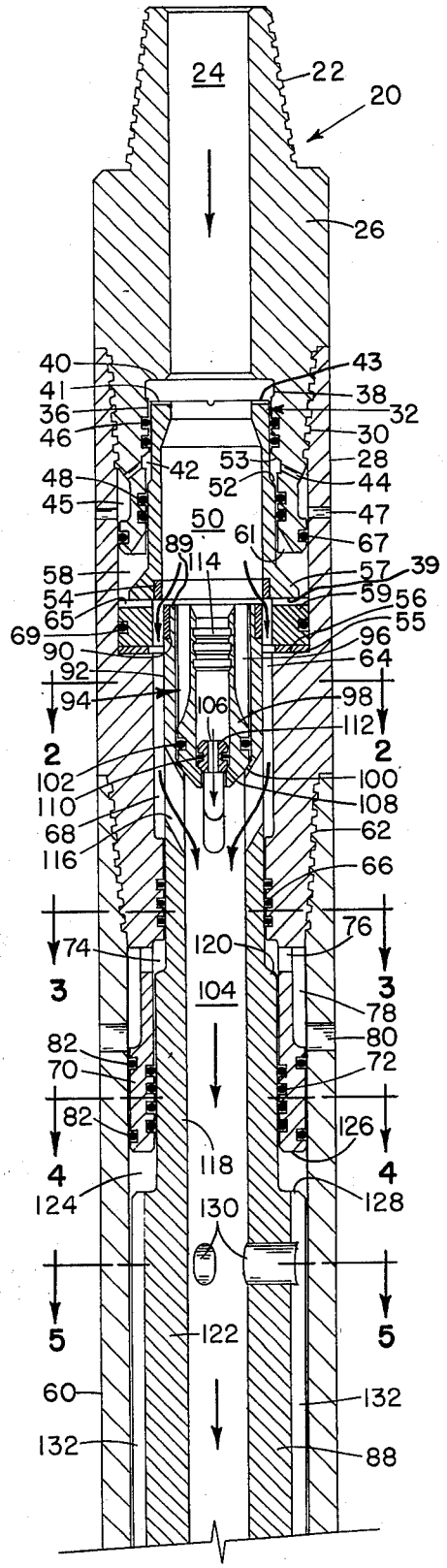
FIG. 1 illustrates an elevated sectional view of the mud drilling tool.
Figure 1:
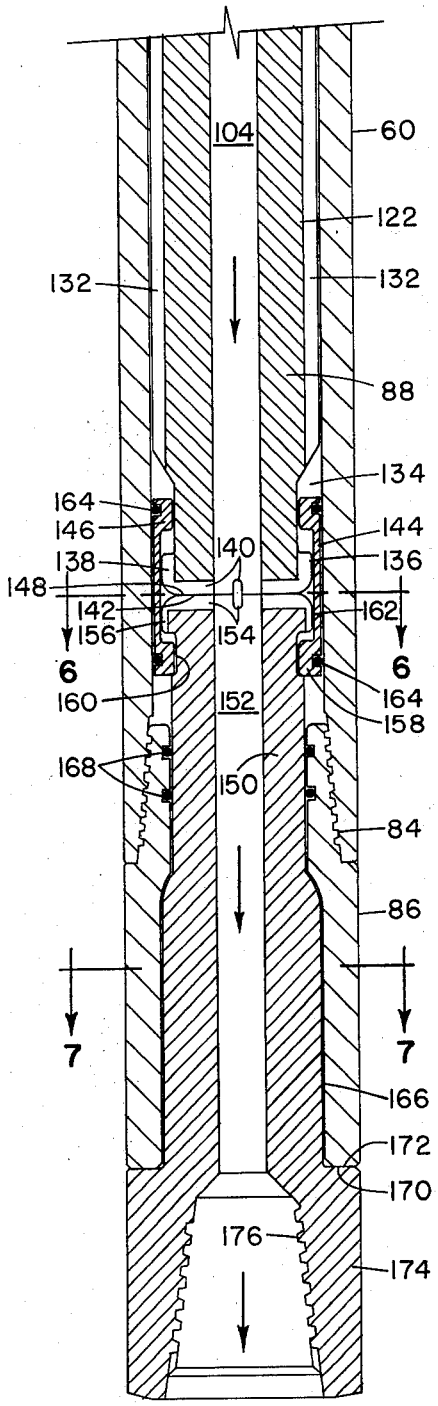

Referring now to FIG. 1 of the drawings, there is an elevated cross sectional view of the preferred embodiment of the mud drilling tool represented generally by the reference numeral 20. The mud drilling tool 20 is designed for connection in a normal string of rotary drill pipe (not shown) immediately above the drill bit (not shown). The top of the mud drilling tool 20 is connected to the string of drill pipe by threads 22 commonly used in the petroleum drilling industry. Mud flowing through the drill pipe (not shown) enters the mud drilling tool 20 through cylindrical bore 24 of upper housing 26. The outside diameter of the mud drilling tool 20 is the same as the outside diameter of the normal drilling pipe connected to threads 22, both being the same outside diameter as upper housing 26. The lower portion of the upper housing 26 is connected to a center housing 28 by means of thread 30.

Between the upper housing 26 and the center housing 28 is located a valve member 32 that is slidably contained in cylinder bore 24. The lower portion of cylinder bore 24 contained in upper housing 26 has an enlarged diameter represented by reference numeral 36. The upper portion of the enlarged diameter 36 has an annular groove 38 cut therein for which purposes will be subsequently described. Immediately above the annular groove 38 is a shoulder 40 against which the top 43 of the valve member 32 may rest as will subsequently be described. Slots 41 are cut in the top of valve member 32.

Between the upper housing 26 and the valve member 32 there is an annular space 42 that is connected to the outside of the mud drilling tool by metered passages 44. The metered passages 44 are sloped downward and connected to the upper part of annulus 45 and outside opening 47 to prevent cuttings contained in the mud that is rising around the outside of the mud drilling tool 20 from reaching the upper and lower valve seals 46 and 48, respectively, and causing damage thereto. The valve seals 46 and 48 are typical piston seals previously used in the petroleum drilling industry with two seals being shown for each seal area. More or less seals may be used in valve seals 46 or 48 as is necessary for the particular tool design. The upper valve seals 46 which surrounds the valve member 32 enclosed an area that will be represented by $^{4}$VU, while the lower valve seals 48 enclose an area represented by $^{4}$VL. Seal 67 prevents the drilling mud from reaching other areas of the drilling tool 20.

The valve member 32 has a center bore 50 that communicates with cylindrical bore 24 by receiving the drilling mud therefrom. The top part of the valve member 32 has a uniform outside diameter with the lower portion of the valve member 32 expanding outward to form a shoulder 52. The center bore 50 expands outward to form a larger diameter center bore in the valve member 32. An annular ring 54 formed from a corrosive resistant substance, such as carbide steel, lines the lower inside portion of center bore 50. The bottom 39 of the valve member 32 rests on seat 59 that is formed from a hard steel. A resilient material 55 such as a rubber washer is located between seat 59 and shoulder 56 of center housing 28. Seat 59 has slots 65 cut therein so that annulus 58 is always in communication with annular space 68. Flange 57 provides sufficient strength to valve member 32 to prevent damage upon hitting seat 59. Mud contained in annulus 58 and between valve member 32 and seat 59 will give a cushioning effect. Undercut 61 allows sufficient clearance so that flange 57 will not strike the bottom of upper housing 26.

The center housing 28 is connected to a lower housing 60 by means of threads 62. Along the axis of center housing 28 is contained a center bore 64 that varies in diameter. The smallest diameter of the center bore is encircled by upper hammer seals 66 that are of a type similar to upper and lower valve seals 46 and 48, respectively. Again, as many seals as are necessary may be used. Immediately above the upper hammer seal 66 is an annular space 68 through which the drilling mud may flow as indicated by the arrows in FIG. 1. The lowermost portion of center housing 28 contains the lower hammer seals 72 that are again of the standard O-ring type similar to upper hammer seals 66. The upper hammer seals 66 enclose an area represented generally by $^{A}$HU, while the lower hammer seals 72 enclose an area represented by $^{A}$HL. Between the upper hammer seals 66 and the lower hammer seals 72 there is an annular space 74 that is connected to the outside of the mud drilling tool 20 through opening 76, downward passage 78 and outside opening 80. Mud seals 82, which are again of a standard type, prevent the mud outside the mud drilling tool 20 that may be carrying the cuttings back to the surface of the well from reaching the hammer area of the mud drilling tool 20. The lower housing 60 is essentially a cylindrical tubing with outside openings 80, threads 62 and lower threads 84 for connection to anvil housing 86 as will be subsequently described.

Contained inside of center bore 64 of center housing 28 and lower housing 60 is a hammer member represented generally by the reference numerals 88. The outside uppermost portion of the hammer member 88 has an annular ring 90 formed from an erosion resistant substance the same as annular ring 54. The outside diameter of the annular ring 90 is slightly less than the inside diameter of annular ring 54 so that annular ring 90 can freely slide inside of annular ring 54.

Figure 2:
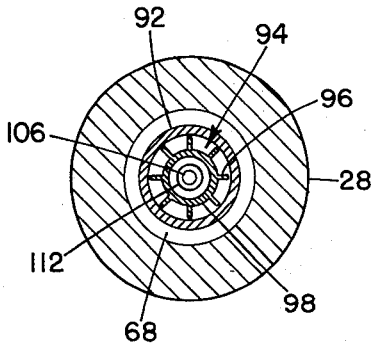
FIG. 2 is a sectional view of FIG. 1 along section lines 2—2.

Inside of an upper cylinder portion 92 of hammer member 88 is a dart represented by the reference numeral 94. Referring to FIG. 1 and the cross sectional view of FIG. 2 in combination, it can be seen that the dart 94 has radial fins 96 to give additional support around the body 98. The dart 94 is simply sitting inside the upper cylinder portion 92 of the hammer member 88 by resting upon shoulder 100. O-ring 102 prevents the drilling mud from leaking around the dart 98 into the cylndrical bore 104 of hammer member 88. Inside of the dart 94 is an orifice 106 formed from a corrosive resistant substance similar to annular rings 54 and 90. The orifice 106 is simply resting on shoulder 108 of dart 94. Again an O-ring seal 110 prevents the drilling mud from leaking around orifice member 112 to reach cylindrical bore 104 of hammer member 88. By using the type of dart just described, the orifice member 112 may be changed to reduce or enlarge the orifice 106 or the entire dart 94 may be changed. By lowering a line from the surface of the well and hooking the end of the line to undercuts 114, and withdrawing the line to the surface, the entire dart 94 can be drawn to the surface of the well in a matter of minutes. Once at the surface, either a new dart 94 may be inserted with a different size orifice 106, or a new orifice member 112 may be inserted in the dart 94 that was withdrawn from the mud drilling tool 20. The dart 94 may be reinserted by simply dropping the dart 94 in the drill pipe and allowing it to flow with the mud until it seats naturally against shoulder 100. By changing the orifice 106, the tuning that may be necessary depending upon the viscosity of the mud, mud density, depth of the well, substance through which the well is being drilled, or the many other variables found in the petroleum drilling industry, can be accomplished by varying the leakage.

As the drilling mud flows through cylindrical bore 24, center bore 50 and through annular space 68, the drilling mud flows back to cylindrical bore 104 of hammer member 88 by flowing through large slotted holes 116 in the upper cylinder portion 92. The large slotted holes 116 are always in communication with annular space 68.

Upper hammer seals 66 surround the upper cylinder portion 92 of the hammer member while lower hammer seals 72 surround center cylinder portion 118. The area $^{A}$HU enclosed by upper hammer seals 66 is smaller than the area $^{A}$HL enclosed by lower hammer seals, with the difference being shown as shoulder 120 in FIG. 1. The area above shoulder 120 is the previously mentioned annular space 74 that is in communication through outside opening 80 with pressures outside the mud drilling tool 20.

Figure 5:
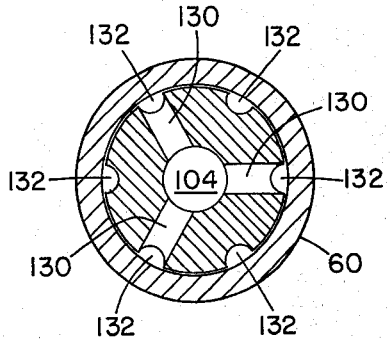
FIG. 5 is a sectional view of FIG. 1 along section lines 5—5.

The lower portion 122 of the hammer member 88 is simply to give extra weight to the hammer member. Immediately above the shoulder 128 of the lower portion 122 is an annular space 124 with the top of the annular space being defined by the bottom 126 of center housing 28. In the lower portion 122 of hammer member 88 are radial slots 130 that communicate with vertical slots 132 that surround the lower portion 122. The radial slots 130 and vertical slots 132 can be best understood by referring to FIGS. 1 and 5 in combination. Though all of the radial slots 130 are shown in the same plane for the purposes of illustration, in actual practice the radial slots 130 would be located in different planes to insure a hammer member 88 of maximum strength. The vertical slots 132 prevent drilling mud from being trapped in the annular space 124 during the reciprocating action of the hammer member 88. There is enough clearance between the hammer member 88 and lower housing 60 to allow free axial movement within the mud drilling tool 20.

Continuing down to the bottom of the hammer member 88, there is an annular space 134 immediately below the vertical slots 132. In the annular space 134 is an annular flange 136 that extends outward from the hammer member 88. In the annular flange 136 are cut vertical slots 138 that connect to cross slots 140 cut in the hammer face 142. Around the annular flange 136 is located a hammer catcher 144 having an inward flange 146 contained in annular space 134.

The hammer face 142 rests against the anvil face 148 of the anvil member 150. In the anvil member 150 there is a cylindrical bore 152 wherein the drilling mud flows from cylindrical bore 104 of the hammer member 88 into cylindrical bore 152 of the anvil member 150. In the anvil face 148 are cut cross slots 154 and vertical slots 156 that match cross slots 140 and vertical slots 138 of hammer member 88. Inward flange 158 of hammer catcher 144 rests inside groove 160 cut in the upper side area of anvil member 150 and immediately below flange 162.

Figure 6:
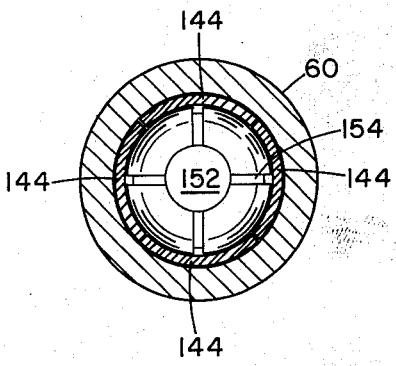
FIG. 6 is a sectional view of FIG. 1 along section lines 6—6.

Referring to FIGS. 1 and 6 in combination a better understanding of the construction of the anvil face and hammer catcher 144 can be obtained. The hammer catcher 144 is made in at least two sections and, for purposes of illustration, the present invention shows the hammer catcher 144 as being made from a total of four sections. The hammer catcher 144 has to be made in sections to allow for assembly. Before the hammer member 88 is inserted in lower housing 60, the hammer catcher 144 is placed thereon and O-ring seals 164 located around the upper and lower portions of the hammer catcher 144. After positioning the hammer catcher 144 around the hammer member 88 and the anvil member 150 and securing it into position with seals 164, the hammer member 88, piston catcher 144 and anvil 150 may be inserted inside lower housing 60.

Figure 7:
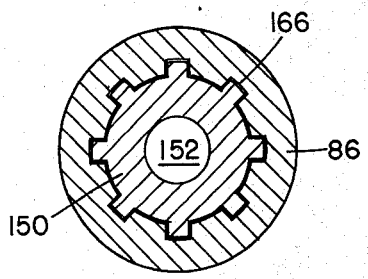
FIG. 7 is a sectional view of FIG. 1 along section lines 7—7.

The anvil member 150 is slidably retained inside of anvil housing 86 by means of slots 166 as can be more easily seen in the sectional view shown in FIG. 7. The anvil member 150 is free to slide along the axis of anvil housing 86. Seals 168 prevent the drilling mud from leaking from the inside of the mud drilling tool to the outside thereof. The bottom 170 of the anvil housing 86 rests against shoulder 172 of anvil member 150. The lower portion 174 of anvil member 150 is connected to a drill bit (not shown) by means of threads 176.

In the present invention there are four seal areas that are of primary concern. The first two seal areas act against the valve member 32 with the area $^{A}$VU defined by the upper valve seal 46 being less than the area $^{A}$VL defined by the lower valve seal 48. As the drilling mud flows through cylindrical bore 24, center bore 50 and through the remaining portions of the mud drilling tool 20, the drilling mud will have a given pressure differential across the drill bit. The pressure differential across the drill bit will cause the valve member 32 to try to move upward because the pressure area $^{A}$VL is greater than the pressure area $^{A}$VU, and the pressure in annular space 45 is less than the pressure being exerted against the valve member 32. To insure that the pressure of the drilling mud flowing through the mud drilling tool 20 reaches the entire surface area and upper valve seals 46, annular groove 38 has been cut at the top of the space that enclosed valve member 32 and slots 41 have been cut in top of valve member 32. Metered passage 44 prevents valve member 32 from hammering against shoulder 40 and seat 59 to such a degree as to damage the mud drilling tool 20.

Figure 3:
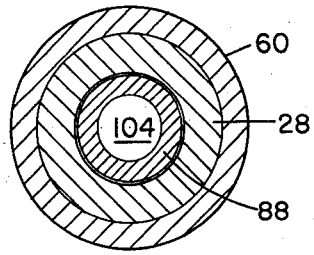
FIG. 3 is a sectional view of FIG. 1 along section lines 3—3.
Figure 4:
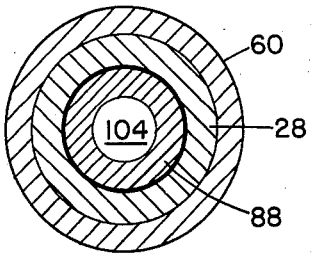
FIG. 4 is a sectional view of FIG. 1 along section lines 4—4.

Referring to the hammer member 88, the area $^{A}$HL defined by lower hammmer seal 72 is greater than the area $^{A}$HU defined by the upper hammer seal 66. Since the pressure in annular space 74 is less than the pressure acting against the valve seal areas $^{A}$HU and $^{A}$HL by an amount substantially equal to the pressure drop across the drill bit, the hammer member 88 will tend to move upward as drilling mud flows through the mud drilling tool 20. The area as defined by the upper hammer seal 66 and the lower hammer seal 72 can be seen in cross sectional views shown in FIGS. 3 and 4. In these cross sectional views, a section is taken between the seals.

METHOD OF OPERATION

The method of operation of the present invention will be described in conjunction with FIGS. 8–11, which show a simplified version of the valve and hammer operation. Like numbers will be used to designate like parts as previously described with the reference numeral 178 representing the casing previously described as upper housing 26, center housing 28 and lower housing 60. Though the mud drilling tool 20 would probably be constructed as shown in FIG. 1, FIGS. 8–11 show the valve and hammer of the mud drilling tool 20 in a simplified form.

Figure 8:
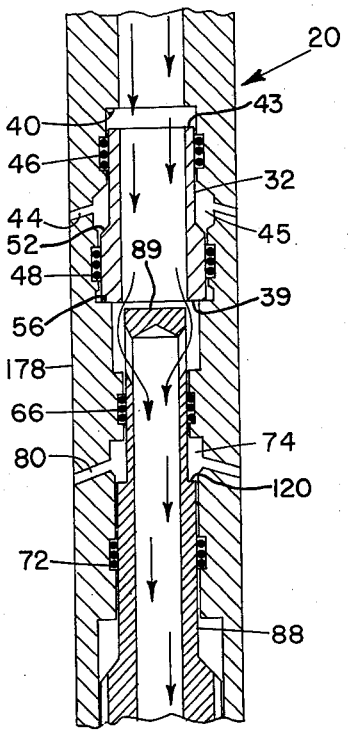
FIG. 8 is a simplified pictorial view illustrating the position of the valve and hammer at the time the mud commences to flow, or the beginning of a cycle of operation.

In FIG. 8, the valve member 32 and the hammer member 88 are resting in their lowermost position with the drill bit against the bottom of the well, the same as shown in FIG. 1. This position represents the beginning of a cycle of operation, the beginning of the flow of mud, or the end of a cycle of operation according to one's reference point. Assume that this is the beginning of the flow of mud and the beginning of the first cycle of operation. The drilling mud flows in the direction indicated by the arrows causing a pressure differential to be developed across the drill bit as determined by the amount of mud flow. Essentially the same pressure developed across the drill bit will be developed across upper valve seals 46, lower valve seals 48, upper hammer seals 66 and lower hammer seals 72 because annular spaces 74 and 45 are connected to the outside of the mud drilling tool 20. Because the area $^{A}$VU enclosed by upper valve seals 46 is less than the area $^{A}$VL enclosed by the lower valve seals 48, there will be an upward force acting against the bottom 39 of valve member 32. Also, because upper hammer seals 66 define a smaller area $^{A}$HU than the area $^{A}$HL defined by the lower hammer seal 72, there will be an upward force acting against the lower face 142 of hammer member 88. The area of the center passage in the valve member 32 and the hammer member 88 would be cancelled out in both instances. For simplicity, the upper portion of hammer member 88 is shown as being solid rather than showing dart 94 shown in FIG. 1. Any leakage that is necessary to prevent excessive backpressures will take place between the valve member 32 and the upper portion of the hammer member 88.

Figure 9:
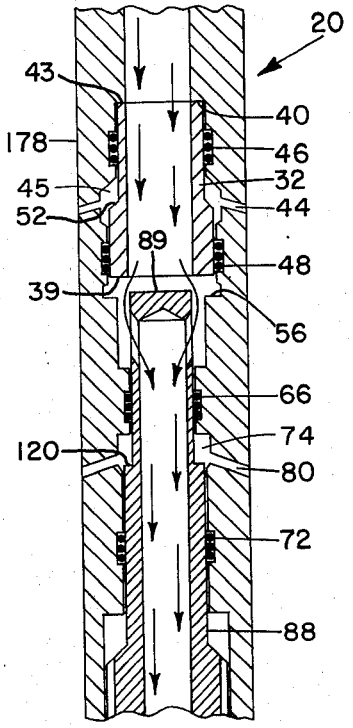
FIG. 9 is a simplified pictorial view of the second position of the valve and the hammer shortly after the mud has started to flow wherein the valve is lifted to its uppermost position and the hammer is beginning to rise upward.

As the same pressure is developed across the top of upper valve seal 46 and the bottom of lower valve seal 48, the valve member 32 begins to move upward because the pressure on the bottom of the valve member 32 is acting on a larger area than the pressure on the top 43 of the valve member 32 as defined by lower valve seals 48 and upper valve seals 46, respectively. The movement of the valve member 32 to the uppermost position against shoulder 40 is rapid because of the relatively light weight of the valve member 32 with the only retention being due to metered passage 44 preventing rapid flow of mud from or to the annulus 45. The position of the valve member 32 after it has reached its uppermost position is shown in FIG. 9. Simultaneous with the upward movement of the valve member 32 due to the difference in the pressure areas $^{A}$VU and $^{A}$VL, the hammer member 88 experiences the same forces. Because the upper hammer seals 66 define a smaller area $^{A}$HU than the area $^{A}$HL of lower hammer seals 72, the hammer member 88 tends to move upward. The hammer member 88 being much heavier than valve member 32, its upward motion is somewhat slower. Again FIG. 9 illustrates a relative position of the hammer member 88 at the time the valve member 32 is resting against shoulder 40.

Figure 10:
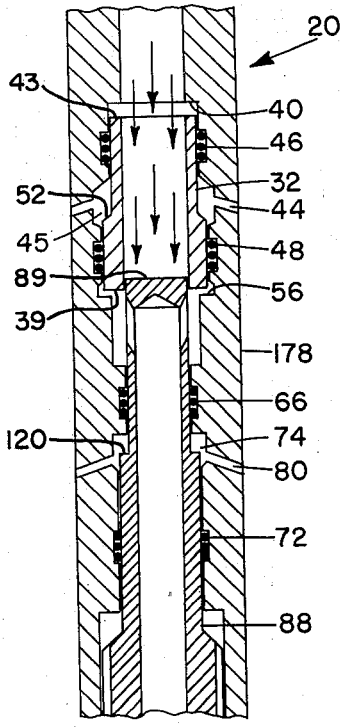
FIG. 10 is a simplified pictorial view of the third position of the valve and hammer as the hammer begins to move into a sliding mating relationship with the valve element.

The hammer member 88 continues to move upward until the top 89 of the hammer member 88 reaches the same plane as the bottom 39 of valve member 32. As they reach the same plane, the downward flow of mud is essentially terminated except for leakage between the valve member 32 and the hammer member 88. Thereafter, the pressure of the mud below the valve member 32 (and inside the mud drilling tool 20) drops to essentially zero. Simultaneously, a backpressure begins developing in the upper portion of casing 178 as represented by the arrows in FIG. 10. This backpressure will be acting against upper valve seal 46 which defined the area $^{A}$VU, while essentially no upward pressure is acting against the lower valve seal area $^{A}$VL. The backpressure literally snaps valve member 32 to its lowermost position against shoulder 56 of casing 178 with metered passage 44 providing the only retention force. FIG. 10 shows the valve member 32 midway between shoulder 40 and shoulder 56 during the snap action.

Figure 11:
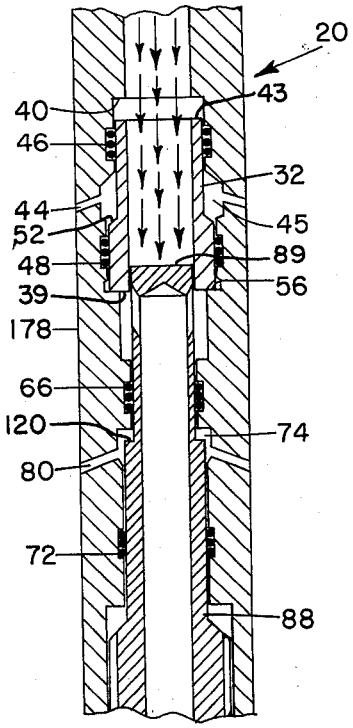
FIG. 11 is a simplified pictorial view of the position of the valve in the hammer as the maximum downward thrust is exerted on the hammer to drive the hammer downward.

After the seating of the valve member 32 against shoulder 56 as shown in FIG. 11 the backpressure in the upper portion of the casing 178 continues to increase as represented by the arrows in FIG. 11. The backpressure is also acting downward on the hammer member 88, but the hammer member 88 being much heavier than the valve member 32 is much slower moving. The backpressure acts across an area $^{4}$HU defined by the upper hammer seals 66, and because of its ever increasing backpressure, stops the upward movement of the hammer member 88 and literally drives the hammer member 88 down with a tremendous force. There is essentially no upward pressure acting on the hammer member 88 once the top 89 of the hammer member 88 reaches the same plane as the bottom 39 of the valve member 32.

The backpressure acting upon area $^{4}$HU as shown in FIG. 11 drives the hammer member 88 to its lowermost position as shown in FIGS. 8 and FIG. 1. The hammer member 88, being of a heavy mass, hits the anvil member 150 with a tremendous impact. The drill bit, which is connected to the anvil member 150, absorbs the downward force of the hammer member 88 by impacting against the structure being drilled. As the hammer member 88 moves downward with its driving force, the upper portion of the hammer member 88 leaves the lower plane of the valve member 32 immediately prior to impact against the anvil 150. This allows the drilling mud to start to flow, reduce the backpressure and create the upward force on the valve member 32 and the hammer member 88, thereby repeating the cycle of operation.

To prevent trapped pressures from being contained inside casing 178, metered passages 44 and openings 80 (previously shown in FIG. 1) are shown in FIGS. 811. The drilling mud that flows up around the outside of casing 178 will enter metered passages 44 and outside openings 80 and will oscillate back and forth therein as the valve member 32 and the hammer member 88 repeat their cycles of operation. The upward slant of metered passages 44 and outside openings 80 is to prevent the cuttings from the well from accumulating inside the casing 178 and damaging one of the seals 46, 48, 66 or 72. Metered passages 44 and outside openings 80 are simplified in FIGS. 8-11.

It should be realized that the backpressure developed during a normal cycle of operation prevents the hammer member 88 from striking a solid object, such as a shoulder of the casing 178, during its upward movement. This backpressure stops the upward movement and provides the tremendous downward force exerted on the hammer member 88.

It should be realized that the principle of operation of the mud drilling tool 20 is based upon two differential area pistons represented by valve member 32 and hammer member 88. The actuating forces of both the valve member 32 and the hammer member 88 are tied to mud pressures above and below each member. There is no problem of synchronization in the present mud drilling tool 20 as was a problem in many of the prior designs. The construction of the mud drilling tool 20 is very simple and rugged. The seals are all piston-cyliner types that have proven trouble free in past applications of a similar nature. All wash-out points are protected by carbide (54, 90 and 112) to prevent excessive wear caused by the pressure and abrasive qualities of drilling mud.

The forces causing reciprocation of the valve member 32 and the hammer member 88 are a direct result of the interplay between the pressure drop downstream of this tool (normally caused in the drill bit) and the pressure drop between the valve member 32 and the hammer member 88. Because the valve member 32 is essentially snap action, the pressure developed across the valve member 32 has a high value when the flow of mud is interrupted and a negligible value when the mud is flowing. The pressure drop across the drill bit or other downstream restriction is essentially constant as determined by the rate of flow of the mud. However, because of the reciprocating action of the hammer member 88, the mud through the drill bit will have a tendency to surge as the hammer member 88 is descending to hit anvil member 150.

It should be realized that the mud drilling tool 20 operates on the principle of varying pressure across a given seal area to provide the piston type action previously described. The areas are fixed and do not change during cycle of operation; only the pressure changes. To prevent trapped pressures, annular space 45 and annular space 74 are connected to the outside of the mud drilling tool 20 by passages as previously described. Also, annular space 124 is connected to the lower portion of the hammer member 88 through vertical slots 132 to again prevent the trapping of a fluid in annular space 124. Vertical slots 138 and cross slots 140 in the hammer, and cross slots 154 and vertical slots 156 in the anvil member 150, prevent the trapping of drilling mud between the hammer face 142 and the anvil face 148. The same is true for slots 41 in the valve member and slots 65 in the seat 59.

If, for some reason, the operation of the mud drilling tool needs to be varied by increasing or decreasing the cycle of operation caused by changing the mud flow rate or other variables common in the petroleum drilling industry, the dart 94 may be fished out in a very short period of time by hooking a line to the undercut grooves 114. By changing the orifice member 112 or the dart 94, the amount of mud leakage can be varied and hence the member of cycles of the mud drilling tool 20 varied during a given time period.

Also, by fishing out the dart 94, direct access can be obtained to the well currently being drilled. This may be necessary for such operations as reaming the hole, increasing the mud flow rate for drilling through sand or other normal drilling operations.

Assume for some reason the drill pipe is raised so that the drill bit no longer touches the bottom of the well, if the mud tool 20 continues to operate, the drill bit would not be resting against a surface that could counteract the hammer action delivered through the anvil member 150 by the hammer member 88. Therefore, the hammer catcher 144, which is hooked to the upper portion of anvil member 150 will move downward as the anvil member 150 moves downward. If the drill is picked up off the bottom of the well, the drill bit and anvil member 150 would slide downward with respect to anvil housing 86 until flange 158 of hammer catcher 144 rests against the uppermost portion of the anvil housing 86. Inward flange 146 of hammer catcher 144 would act against annular flange 136 of hammer member 88, thereby pulling the hammer member 88 downward. The downward pull on the hammer member 88 together with its own weight would overcome any variation in pressure across areas $^{A}HU$ and $^{A}HL$. Also, the pressure developed across the drill bit will tend to pull the hammer member 88 down. Since the hammer member 88 is now held in the down position, the mud can flow freely through the mud drilling tool 20 with the valve member 32 remaining in the uppermost position and the hammer member 88 remaining in the lowermost position. In normal drilling operations it is not uncommon for as much as 50,000 pounds of downward force to be exerted on the drill bit. Upon picking the drill bit off the bottom of the well this downward force is no longer exerted and will not shove the anvil member 150 against shoulder 172 of the anvil housing 86.

What is claimed is:

1. A fluid actuated impact drilling tool for use in rotary drilling comprising:

housing means;

means for connecting said housing means in a string of drilling pipe;

flow means through said housing means for allowing a fluid flowing in said drilling pipe to flow through said housing means;

single valve means slidably mounted in said housing means;

hammering means slidably mounted in said housing means, said single valve means and said hammering means moving independently of and relative to each other for periodically interrupting substantial flow of said fluid in said flow means by first moving along the axis of said drilling tool until both reach a plane perpendicular to said axis, said interruption of said fluid causing an increase in pressure of said fluid above said plane which drives both said single valve means and hammering means in the direction opposite the first direction of movement along said axis;

said first movement of said single valve means and said hammering means being caused by a pressure differential between the fluid inside said flow means and outside of said housing means, pressure causing said pressure differential acting on given surfaces of said single valve and hammering means as defined by pressure areas enclosed by seal means; and said housing means including an upper and a lower end with said fluid flowing in said upper end, through said housing means and out said lower end thereof, said hammer means forming a portion of said flow means that is in continuous and uninterrupted communication with said lower end of said housing means.

2. The fluid actuated impact drilling tool as recited in claim 1 wherein said valve means and said hammering means move in a telescoping contiguous manner for said periodically interrupting substantial flow.

3. The fluid actuated impact drilling tool as recited in claim 2 wherein said given pressure areas include at least two seals of different sizes for said valve means and at least two seals of different sizes for said hammering means, pressure outside said tubular housing means being communicated to said seals to establish said pressure differential.

4. The fluid actuated impact drilling tool as recited in claim 3 wherein said fluid is drilling mud used in the petroleum drilling industry, and said valve means and hammering means allows for leakage of some of said drilling mud upon said interruption of substantial flow.

5. The mud actuated impact drilling tool as recited in claim 4 wherein said valve means and said hammering means move upward in response to said pressure differential, and are driven downward upon said interrupting of substantial flow of said drilling mud, said hammering means impacting against anvil means to which a drill bit may be attached, interruption of substantial flow being terminated immediately prior to said impact to repeat the cycle.

6. The mud actuated impact drilling tool as recited in claim 5 wherein said valve means operates between limiting stops of said tubular housing means, said hammering means being slidably received into a center flow passage of said valve means to interrupt flow therethrough, said interruption increasing mud pressure above and decreasing pressure below both said valve means and hammering means thereby forcing both downward.

7. The mud actuated impact drilling tool as recited in claim 6 further includes means for holding said hammering means down upon picking up said string of drilling pipe, said holding means being retained by said hammering means and said anvil means to prevent said interruption of the flow of drilling mud.

8. The mud actuated impact drilling tool as recited in claim 6 wherein a plug member having an orifice therethrough is removably inserted in said hammering means, removal of said plug member stopping the movement of said valve means and said hammering means while simultaneously allowing normal drilling access below said drilling tool.

9. The mud actuated impact drilling tool as recited in claim 6 includes erosion resistive material at points subject to wear by mud flow.

10. A mud actuated impact drilling tool for use in rotary drilling comprising:

tubular housing means having a means for connecting into a string of drilling pipe, said tubular housing means having a flow passage therethrough to allow flow of drilling mud;

restriction means below said mud actuated impact drilling tool to cause a pressure differential between the inside and outside of said tubular housing means with said inside being of a greater pressure during flow of drilling mud;

single valve means slidable along axis of and contiguous with said tubular housing means between an upper and a lower stop position, said sliding movement of said valve means being caused by pressures being exerted against valve surfaces defined by at least two valve seal areas of different sizes, said pressure differential existing across said two valve seal areas;

hammering means slidable along said axis of and contiguous with said tubular housing means, said sliding movement of said hammering means being caused by said pressures being exerted against hammer surfaces defined by at least two hammer seal areas of different sizes, said pressure differential existing across said two valve seal areas;

anvil means located below said hammering means and slidably retained by said tubular housing means, said anvil means including a part of said connecting means whereby said restriction means is attached thereto;

said single valve means and said hammering means periodically interrupting substantial flow of said drilling mud through said flow passage by overlapping of said sliding movements thereof, an upward movement of said single valve means and hammering means being caused by said pressure differential across said valve surfaces and said hammer surfaces, respectively, a downward movement of said single valve means and hammering means being caused by backpressure of said drilling mud due to said substantial interruption of flow;

leakage means for allowing some drilling mud to continue to flow through said flow passage during said substantial interruption of flow to prevent excessive backpressure, said backpressure pushing against at least one valve surface and at least one hammer surface;

said hammering means striking said anvil means during said downward movement to drive said anvil means and restriction means downward.

11. The mud actuated impact drilling tool as recited in claim 10 wherein restriction means is a drill bit, said impact drilling tool having erosion resistive material at said leakage means to prevent excessive wear from the drilling mud.

12. The mud actuated impact drilling tool as recited in claim 11 further includes means for holding said hammering means down upon picking up said string of drilling pipe, said holding means being retained by said hammering means and said anvil means to prevent said substantial interruption of the flow of drilling mud.

13. The mud actuated impact drilling tool as recited in claim 12 further includes a dart member having an orifice therethrough, said dart member being removably inserted in said hammering means, removal of said dart member allowing uninterrupted flow of said drilling mud and access to said drill bit.

14. The mud actuated impact drilling tool as recited in claim 13 further includes a seat means retained in said housing against which said valve means seats upon reaching said lower stop, said seat means preventing damage by said valve means.

15. The mud actuated impact drilling tool as recited in claim 14 further includes slot means to prevent trapping of fluids and allowing access to said valve seal areas and said hammer seal areas.

* * * * *